US005372557A

United States Patent [19]

Ostigny

[11] Patent Number: 5,372,557

[45] **Date of Patent: * Dec. 13, 1994**

[54] HAND, WRIST AND FOREARM EXERCISER

[75] Inventor: David Ostigny, Cincinnati, Ohio

[73] Assignee: TRX, Inc., Cincinnati, Ohio

[ * ] Notice: The portion of the term of this patent subsequent to Apr. 13, 2007 has been disclaimed.

[21] Appl. No.: 205,655

[22] Filed: Jun. 13, 1988

[51] Int. Cl.[5] ..... A63B 23/14

[52] U.S. Cl. ..... 482/49; 482/121

[58] Field of Search ..... 272/68, 135

[56] References Cited

U.S. PATENT DOCUMENTS

| | | | |
|---|---|---|---|
| 2,848,234 | 8/1958 | Brandon . | |
| 3,162,443 | 12/1964 | Petri | 273/73 R |
| 3,687,458 | 8/1972 | Proctor | 272/68 |
| 4,021,040 | 5/1977 | Inoue . | |
| 4,192,500 | 3/1980 | Crow et al. | 272/68 |

*Primary Examiner*—Richard J. Apley
*Assistant Examiner*—Franklin Gubernick

[57] ABSTRACT

An exerciser for simultaneously strengthening the finger, hand, wrist and forearm, comprising a head section connected to a handle section. The head section has enclosed within its rigid perimeter edge a solid flexible material which, when the exerciser is in use, generates air resistance to twisting and turning movements of the wrist and the forearm. The handle section comprises two moving components positioned in facing opposition to each other on opposites sides of a shaft which is connected to the head section. The moving components are connected to each other and to the shaft by springs which cause the moving components to be spaced apart from the shaft. In use, the handle provides gripping resistance to the fingers and hand of the user. An elastic sleeve surrounds the handle assembly to prevent pinching of the user's hand.

5 Claims, 1 Drawing Sheet

HAND, WRIST AND FOREARM EXERCISER

BACKGROUND OF THE INVENTION

1. Field of the Invention

The present invention relates to an exercising device designed to strengthen the fingers, hand, wrist and forearm simultaneously as a unit.

2. Prior Art

In many human endeavors the fingers, hand, wrist and forearm must simultaneously work together in order to perform certain tasks. Finger and hand muscles are used for griping firmly while wrist and forearm muscles are used for twisting and turning. For example, when using a screwdriver, the fingers and hand are used to grip the tool firmly while wrist and forearm simultaneously twist and turn the tool. A policeman who needs to control a disorderly and possibly dangerous person, can grip that person's arm firmly by using his fingers and hand, but he must rely on his wrist and forearm in order to simultaneously twist, turn and bend the assailant's arm behind his back.

Despite a need for the fingers, hand, wrist, and forearm to work together in this manner there exists no exercise device that simultaneously offers grip resistance to the fingers and hand, and twisting and turning resistance to the wrist and forearm, without limitation or restriction. There are devices found in prior art having spring loaded grips. They offer resistance to the griping movement of the fingers and hand but offer limited, restricted, little or no resistance to the simultaneous twisting and turning movement of the wrist and forearm.

Inoue, U.S. Pat. No. 4,021,040, presents a spring loaded grip on a barbell. Inoue's invention does simultaneously offer resistance to both the griping movement of the fingers and hands, and the twisting and turning movement of the wrist and forearm except in a very limited and restricted way. Weight is the means of resistance offered to the twisting and turning movement of the wrist and forearm. Weight is only resistant when it is moved upward. The user of Inoue's invention is limited and restricted to an upward motion. Weight also involves other muscles to work unwillingly, causing stress, stain and sometimes injury.

Brandon U.S. Pat. No. 2,848,234 presents a spring loaded grip on a golf club. Again, although the spring loaded grip offers resistance for the griping of the fingers and hand, there is little or no resistance offered to the twisting and turning movement of the wrist and forearm. The weight of the club, once momentum is established, actually offers the user assistance rather than resistance in performing the exercise. The weight and momentum of the club on the downward wing works like a Pendulum. The user never needs to apply twisting or turning forces in order to push the club through the swing.

Clearly there is a need for an exercise device that simultaneously offers gripping resistance to unrestricted twisting and turning resistance to movement of the wrist and forearm. A spring loaded grip combined with a means of generating air resistance to the twisting and turning movement of the wrist and forearm would simultaneously provide resistance to the griping of the hand, and twisting and turning of the wrist and forearm without restricting or limiting the twisting and turning movement of the wrist and forearm. Such a devise does not exist in the prior art.

SUMMARY OF THE INVENTION

The exerciser of the present invention device which includes a solid head area which, when in use, generates air resistance, to the twisting and turning movements of the wrist and forearm. The head portion is attached to a spring loaded handle portion which, when in use, provides resistance to the griping movement of the fingers and hand. The user of the present invention can freely move his hand, wrist and forearm in any direction, and always against resistance to movement, thereby strengthening his hand, wrist and forearm as a unit.

The present invention will become more apparent upon reading the following detailed description with reference to the drawings.

DESCRIPTION OF THE PREFERRED EMBODIMENTS

Figure 1:
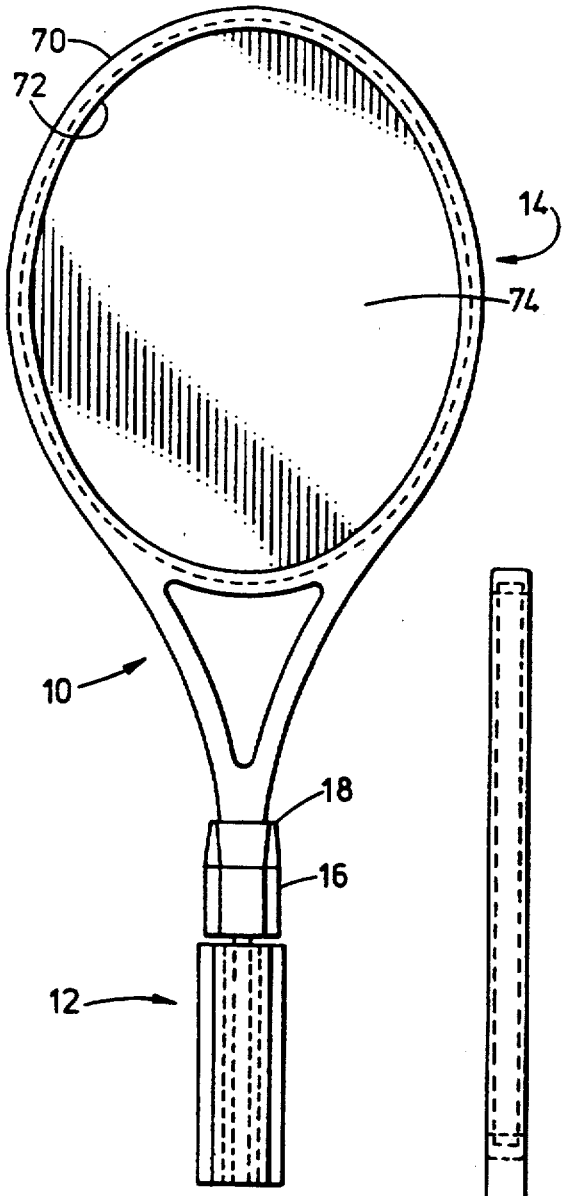
FIG. 1 illustrates a front elevational view of the present invention.

FIG. 1 shows a preferred embodiment of the exerciser which is designated by numeral 10. The exerciser is racquet shaped, having a handle section 12 which is attached to a head section 14.

The handle section 12 comprises a shaft 16 and a handle assembly 30. One end of the shaft 18 is attached to the head section 14, the other end 20 is co-axially attached to a thin shaft 22 which extends to the end of the handle section 12 at 24.

Figure 3:
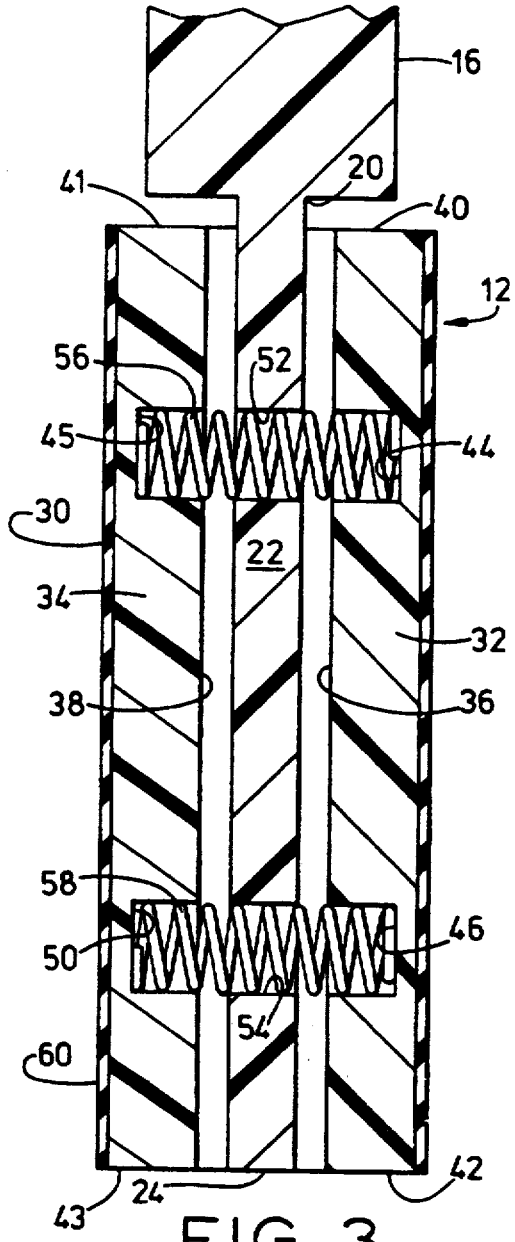
FIG. 3 is a fragmentary cross-sectional view of the invention taken along line 3—3 of FIG. 2.
Figure 2:
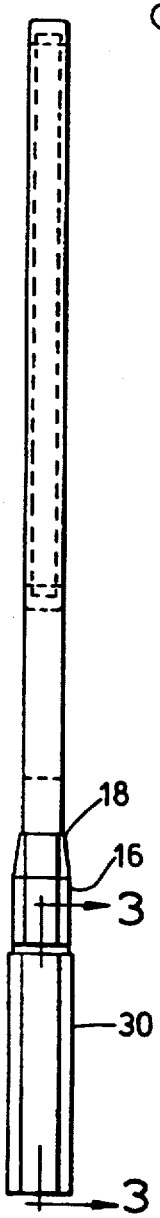
FIG. 2 represents an edge view of the present invention.

As best illustrated in FIG. 3, the handle assembly 30 comprises a first moving component 32 and a second moving component 34. Each moving component has an inner face 36 and 38, respectively, a top 40 and 41, respectively and a bottom 42 and 43, respectively. The design of the first and second movable component 32 and 34, respectively, is such that one the mirror image of the other. The first and second moving components 32 and 34 are positioned on opposite sides of the thin shaft 22 in a manner that the longitudinal axis of said thin shaft 22 and said first and second moving components 32 and 34 are parallel. Those skilled in the art will understand that the longitudinal dimensions of the thin shaft 22 and the first and second moving components 32 and 34 will be approximately equal, and the length dimension will be that of normal racquet handle. The length of the moving components is slightly less than that of the thin shaft 22 so that when the bottom of the thin shaft 24 and the bottom of said moving components 42 and 43 are in alignment a slight gap exists between the tops of the moving components 40 and 41 and the end of the shaft 16 at 20.

The inner face 36 of the first moving component 32 contains a top cavity 44 located near the top of said first moving component, and a bottom cavity 46 located near the bottom of said first moving component. Similarly, the inner surface 38 of the second moving element 34 contains top and bottom cavities 48 and 50, respectively, equal in size, shape and all other dimensions to cavities 44 and 46 in the first moving component 32, and positioned on the second moving component 34 so that the pairs of cavities are in facing alignment.

The thin shaft 22 has a top hole 52 and a bottom hole 54 bored through it. The holes 52 and 54 are located on the longitudinal axis of the shaft so that each hole aligns with an opposing pair of top cavities 44 and 45 and bottom cavities 46 and 50 when the first and second moving components 32 and 34 are placed on either side of the thin shaft, such that the inner faces of said moving elements are in facing opposition and such that the bottom of the thin shaft 24 and the bottom of each moving element 42 and 43 are in alignment. The overall effect is to produce two internal chambers within the handle assembly 30. Referring to FIG. 3, a top chamber is formed by cavities 44 and 48 and hole 52 and a bottom chamber is formed by cavities 46 and 50 and hole 54.

Holes 52 and 54 are positioned radially about the thin shaft 22 so that their longitudinal axis is perpendicular to the face of the exerciser.

Springs 56 and 58 are installed in the top and bottom chambers contained within the handle assembly 30. Each end of each spring is tightly and securely fitted in one of the cavities. The diameter of holes 52 and 54 is slightly larger than the diameter of the spring, so that the spring passes through, but does not touch the inner face of the holes.

In the preferred embodiment springs 56 and 58 are identical in all respects. The length of springs 56 and 58 is selected so that in the normal, ungripped position, the first and second moving components 32 and 34 will be separated from the thin shaft 22 by an equal distance. The tension of the springs 56 and 58 is selected to create a desired gripping resistance to the movement of the said moving components toward the thin shaft 22.

Those skilled in the art will recognize that the springs are the fastening means of the first and second moving elements 32 and 34 to the thin shaft 22. The springs also separate first and second moving components from the thin shaft 22 under spring tension. This arrangement permits the user to grip the exerciser 10 and to squeeze the first and second moving components 32 and 34 towards each other until the inner faces of said moving elements 36 and 38 reach and are stopped by the thin shaft 22. As will be seen below, this in one component of the exercise provided by the device of the present invention.

In order to present the user's hand from being pinched as he closes the gaps between the moving components and the thin shaft, an elastic sleeve 60 is positioned about the handle assembly 30.

The perimeter of head section of the exerciser 14 is determined by a rigid edge 70 which defines the opening 72. The shape of the head section 14 may be of any freeform, but symmetrical with respect to the vertical axis of the exerciser. Thus while the drawings herein illustrate the device in the shape of a rectangle, it will be understood that the head section can be in the shape of a heart, an oval, a circle, a hexagon, or any other fanciful shape without altering the effectiveness of the exerciser.

In the preferred embodiment, the opening 72 is filled with a flexible material 74. The nature of the flexible insert 74 is such that when the exerciser is in use and moving through the air, the inset 74 wafts like a sail or like a flag. Insert 74 may be made of many material, such as but not limited to, cloth, canvas, leather, styrofoam, and various other plastics. Functionally it is possible to produce a single piece solid head section 14. However, the advantage of installing a separate insert 74 into opening 72 is that the insert 74 may be replaced from time to time. This feature enables the user to vary the air resistance of the exerciser by altering the flexibility of the insert 74.

In operation the user grips the exerciser 10 by the handle 30. He twists and turns in a freestyle manner the head of the exerciser through the air while he simultaneously squeezes the movable components of the handle 34 and 36 toward the thin shaft 22.

The operating principle of the exerciser is to stress the muscles of the hand, wrist and forearm simultaneously by providing spring resistance in the grip of the handle 30 and air resistance to the movement of the exerciser. As such, it is clear that the design of the present invention permits the replacement of springs 56 and 58, to allow the user to increase of decrease the handle spring tension.

While the invention was described in connection with the preferred embodiments, it will be understood that it is not intended to limit the invention to the preferred embodiments. On the contrary, it is intended to cover all alternatives, modifications and equivalents as may be included within the spirit and scope of the invention.

What is claimed is:

1. A hand, wrist and forearm exerciser, in the shape of a racquet, comprising:

(a) a head section comprising:

(1) a rigid edge defining the shape and perimeter of said head section said edge surrounding an opening; and (2) a solid, flexible planar face, located in the opening created by said rigid edge, which, when the exerciser is swung through the air creates air resistance to the movement of the exerciser; and (b) a handle section comprising:

(1) a shaft connected at one end to said head section;

(2) at least two moving components attached to the other end of said shaft and positioned about said shaft so that when said exerciser is not in use a gap exists between said shaft and said moving components, and when said exerciser is in use and a user forces said moving components towards the shaft said moving components adjoins to and aligns with said shaft so that their vertical axes are parallel to the vertical axis of the shaft; and (3) spring means attached to said moving components and to said shaft to provide resistance to movement of the moving components toward the shaft when the exerciser is in use, and to maintain the said gap between the moving components and the shaft when the exerciser is not in use.

2. The device of claim 1, wherein the shape of the said rigid edge is symmetrical with the vertical axis of the exerciser.

3. A hand, wrist and forearm exerciser in the shape of a racquet, comprising:

(a) a head section comprising:

(1) a rigid edge defining the shape and perimeter of said head section by said edge surrounding an opening; and (2) a solid, flexible planar face, located in the opening created by said rigid edge, which, when the exerciser is swung through the air, creates air resistance to the movement of the exerciser; and (b) a handle section comprising:

(1) a shaft connected at one end to said head section;

(2) a first moving component and a second moving component each having an inner face, each inner face being of symmetrical design to the other when the respective inner faces oppose one another, positioned on opposite sides of said shaft such that the longitudinal axis of said shaft and the longitudinal axis of each moving component are parallel to each other, spaced approximately equally apart from said shaft and positioned about said shaft so that when the exerciser is not in use the resulting gaps between each moving component and the shaft are equal and parallel to said face of said head section, and when the exerciser is in use and a user forces said moving components towards the shaft, said first and second moving components adjoin and align on the opposite sides of said shaft; and (3) spring means located between and attached to said first and second moving components and attached to said shaft to provide resistance to movement of the said first and second moving components toward the shaft when the exerciser is in use, and to maintain the gap between the moving components and the shaft when the exerciser is not in use.

4. The device of claim 3, wherein said spring means comprises:

(a) a top inner chamber and a bottom inner chamber located inside near the top and near the bottom of said handle section, each inner chamber being formed by an opposing pair of cavities located on the inner face of the first and second moving component and a hole in the shaft, the axis of said hole being perpendicular to the planar face of the exerciser and in alignment with said pair of cavities; and (b) a top spring and a bottom spring, positioned respectively within the said top chamber and said bottom chamber and passing through the hole in the shaft corresponding with each chamber with the ends of each spring secured to the ends of its respective chamber, the length of each spring being such that when the exerciser is not in use said gap between the said shaft and the said first and second moving components is formed.

5. The device of claim 4, and an elastic sleeve fitted over the said first and second moving components in order to prevent the user's hand from being pinched.

* * * * *